United States Patent [19]

John

[11] 4,222,548

[45] Sep. 16, 1980

[54] UNITARY OIL BLOCK

[75] Inventor: Julius F. John, Gardena, Calif.

[73] Assignee: Norco Industries, Inc., Gardena, Calif.

[21] Appl. No.: 35,213

[22] Filed: May 2, 1979

[51] Int. Cl.[3] ..... B66F 5/04

[52] U.S. Cl. ..... 254/8 B; 151/70

[58] Field of Search ..... 254/2 B, 8 B, 93 R, 254/124; 85/45; 151/70

[56] References Cited

U.S. PATENT DOCUMENTS

| | | | |
|---|---|---|---|
| 2,106,278 | 1/1938 | Redmer | 85/45 |
| 4,018,421 | 4/1977 | Tallman | 254/8 B |
| 4,131,263 | 12/1978 | John | 254/8 B |

*Primary Examiner*—Robert C. Watson

[57] ABSTRACT

A unitary multiple purpose oil block for use with and in cooperation in a lifting jack features a rigid block anchored between a pair of side plates comprising a frame adjacent one end. On various faces of the block holes are drilled for mounting the operating mechanisms, namely a hydraulic power cylinder, a pump, a lift-lower control valve and an overload release. Extensions of the holes are drilled to form passages of the hydraulic network with all passages in respective right angular relationship communicating with each other within a central partition between a pair of oil reservoir chambers. The operating mechanisms are separately mounted for purposes of economy of weight, simplicity, easy access and servicing.

6 Claims, 9 Drawing Figures

UNITARY OIL BLOCK

A popular type of axial lifting jack of the hydraulic type is one suggested in general by U.S. Pat. Nos. 4,018,421 and 4,131,263. These lifting jacks although capable of elevating virtually any type of load, are especially popular and have appreciable utility when used for lifting the axle of an automotive vehicle. Such jacks may lift a wheel at one end or the other of the axle or if prefered may be centered so as to lift the entire axle on occasions. With the increasing numbers of compact and sub-compact automobiles, there has been a demand for portable hydraulic lifting jacks which are compact and are lightweight while at the time having the capacity for lifting most types of automotive and recreational vehicles.

Heretofore, such axle jacks have had their greatest popularity in garages and service stations where equipment, because of its weight and size, has been largely confined. More recently, as evidenced by U.S. Pat. Nos. 4,018,421 and 4,131,263 there have been appreciable improvements making possible construction of axle jacks of relatively lighter weight and appreciably smaller size, to such an extent that they have been acceptable as a jack to be carried about in the trunk compartment.

As the size of automotive vehicles has become smaller and smaller, even those lifting jacks of relatively lighter weight have been limited in acceptability. Further still, with the rapidly increasing costs of the materials and workmanship, lifting jacks, which are to a degree complex in their machining and assembly, face merchandising obstacles which inhibit what would otherwise be widespread use.

It is therefore among the objects of the invention to provide a new and improved hydraulic lifting jack especially suited to use as an axle jack of such simplified construction that it can be constructed at less cost than those heretofore available, without sacrifice in utility or in capacity.

Another object of the invention is to provide a new and improved relatively lighter weight and lower priced axle jack of the hydraulic type where what has been termed the oil block as of unitary character, housing the entire hydraulic network as well as accommodating operating parts of the hydraulic network, in addition to serving as a mount for the sundry operating parts.

Still another object of the invention is to provide a new and improved hydraulic axle jack of the protable type which is small and compact when retracted and with no fittings protruding unnecessarily, and which at the same time is exceptionally rugged, having been made so by having a unitary oil block serve a multiple purpose, namely, that of strengthening and reinforcing the structural frame or chassis, the operating parts additionally being simplified both as to structure and location so as to be within easy reach for operation and also easily accessible for maintenance and repair.

Still further among the objects of the invention is to provide a new and improved hydraulic axle jack of especially simplified and lightweight construction, but which nevertheless contains all of the mechanical requisites of a full duty lifting jack embodied in a stable heavy unit, with a separate lift-lower control and effective overload release.

With these and other objects in view, the invention consists of a construction, arrangement, and combination of the various parts of the device, whereby the objects contemplated are attained, as hereinafter set forth, pointed out in the appended claims, and illustrated in the accompanying drawings.

Figure 1:
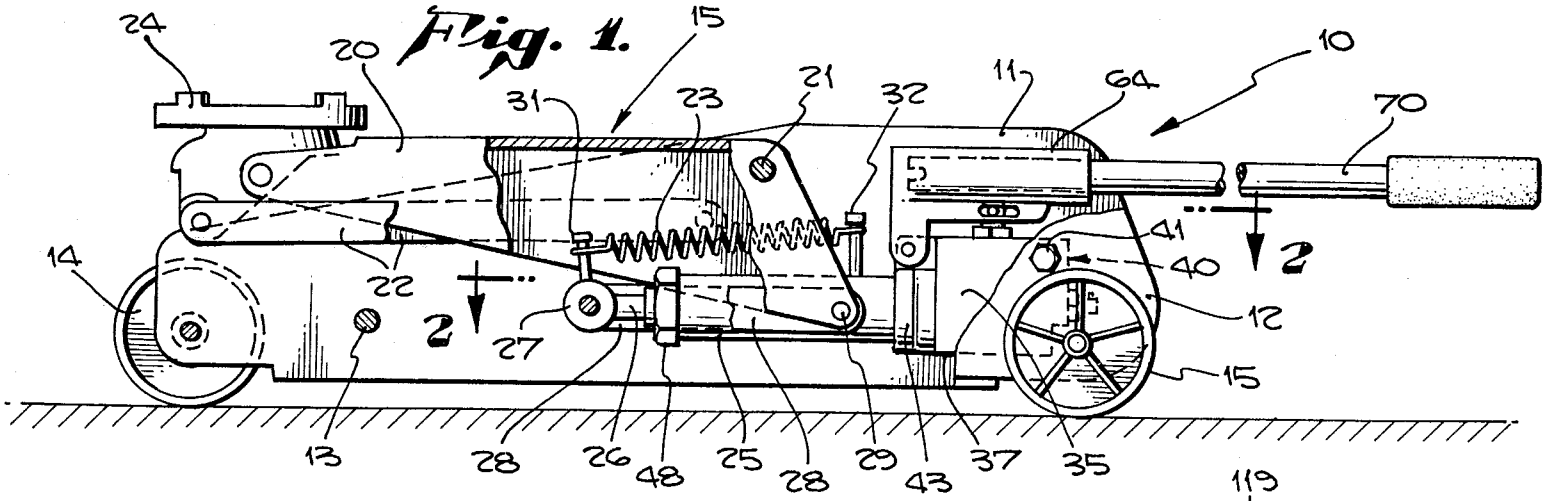
FIG. 1 is a side elevational view partially broken away showing a characteristic frame and linkage for use with a hydraulic lifting jack.
Figure 9:
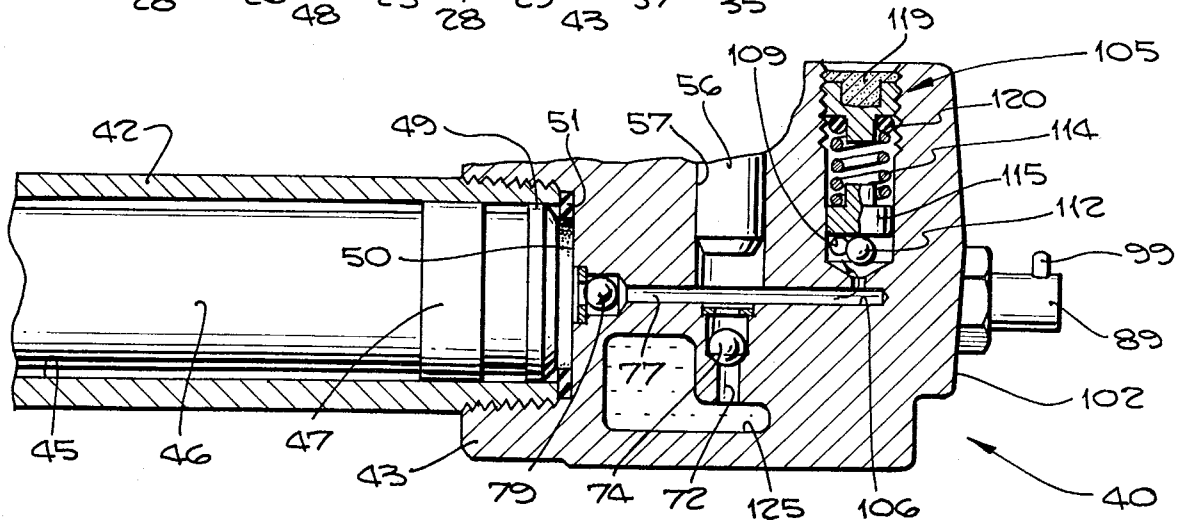
FIG. 9 is a fragmentary longitudinal sectional view similar to FIGS. 4 and 5 but illustrating still another aspect of operation.

In an embodiment of the invention chosen for the purpose of illustration by way of environment there is shown, particularly in FIG. 1, an axle lifting jack indicated generally by reference character 10. The general construction of the lifting jack is substantially conventional to the extent of providing a frame assembly including side plates 11 and 12 interconnected by appropriate spacers and spreaders including a bolt 13. The forward wheels are exemplified by the wheel 14 and rear wheels by the wheel 15 providing rolling support for the frame assembly.

An elevating linkage indicated generally by the reference character 15 includes an elevator arm 20 attached to the respective side plates 11 and 12 by means, for example of a pivot pin 21, substantially as shown in U.S. Pat. No. 4,018,421. Forming part of the elevating linkage are a pair of control arms 22, likewise attached to the side plates 11 and 12 respectively, by pivot pins 23. The elevator arm 20 and control arms 22 together engage a lifting platform 24 which is adapted to engage the axle of an automotive vehicle or other object to be elevated. The motivating force for the elevating linkage is provided by a hydraulic power unit 25, acting through a piston rod 26 and trunion 27 to extend trunion arms 28 which are pivotally attached to the elevator arm by pivot pins 29. A stabilizing spring 30 is attached to the trunion 27 by means of a post 31 and to the hydraulic power unit 25 by means of a post 32.

The invention is largely embodied in a unitary oil block 40 anchored in position between the side plates 11 and 12 by appropriate bolts 41. Anchored in this fashion, the block serves as a spreader for the side plates and actually as a structural component of the entire lifting jack. End walls 35 and 36 of the block 40 are parallel and drawn firmly into face-to-face engagement with adjacent faces of the respective side plates 11 and 12. A bottom wall 37 extends horizontally between the respective side plates and is parallel to an upper wall 38. The hydraulic power unit 25, previously identified, consists in part of a hydraulic cylinder 42 having a threaded engagement with a boss 43 on an inner or forward side wall 44 of the block 40. The hydraulic cylinder 42 provides a chamber 45 in which is reciprocatably mounted a piston 46 and an accompanying piston ring 47. The piston rod 26, previously identified, is mounted at the left end of the piston 46, surrounded by an appropriate packing 48. To the right of the piston 46 there is a piston head 49 providing an appropriate expansion of pressure chamber 50 for reception of appropriate hydraulic fluid under pressure. The expansion chamber is made tight by means of a seal 51.

In the block 40 is a reservoir of hydraulic fluid, preferably oil, the reservoir consisting of opposite closed pockets 52 and 53 of substantially equal capacity interconnected by means of a passageway 54. It is from the hydraulic reservoir consisting of the pockets and passageway that oil is pumped to provide hydraulic pressure for the pressure chamber 50 of the hydraulic power unit 25.

For pumping hydraulic fluid from the reservoir to the expansion chamber, there is provided a pump assembly indicated generally by the reference character 55 and consisting mainly of a piston 56 reciprocatably mounted in a pump chamber 57. A packing gland 58 engages a threaded recess 59, and confines a pair of sealing O rings 60 and 61 within a carrier 62. The packing gland 58 itself has a sealing O ring 63.

Figures 2, 3:
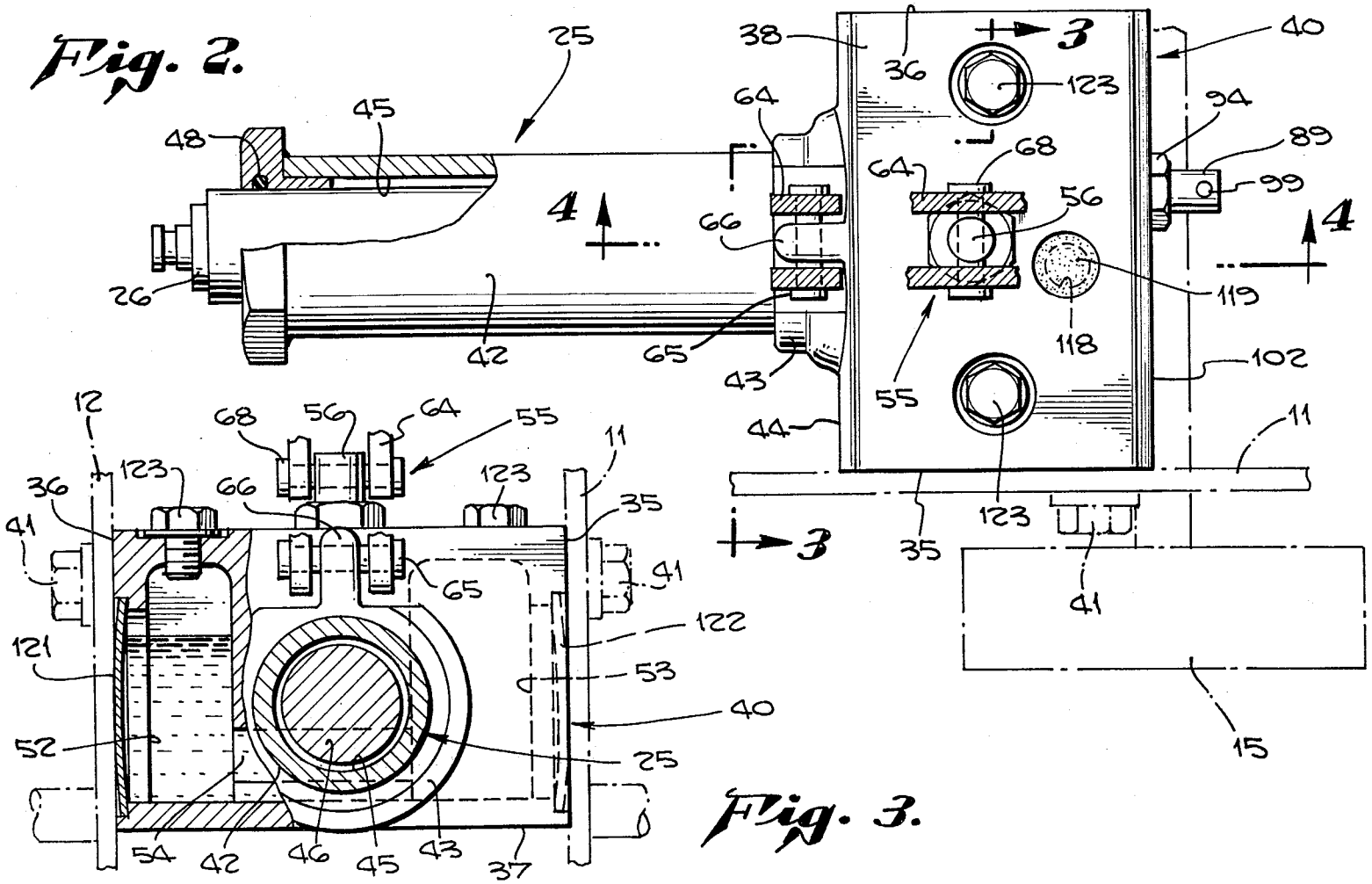
FIG. 2 is a fragmentary plan view on the line 2—2 of FIG. 1, partly broken away.
FIG. 3 is a cross-sectional view of the line 3—3 of FIG. 2.

For manipulating the piston 56 there is provided a yoke 64 pivotally mounted by means of a pin 65 on a flange 66. Actually the flange is a cutout portion of the boss 43, the cutout portion being clearly visible in FIG. 3. A slot 67 accommodates a pin 68, the pin being fixed in the outer end of the piston 56. The yoke is provided with an elongated opening 69 into which a separate handle 70 can be thrust when the pump is to be operated, and withdrawn therefrom after operation is complete.

A portion of the hydraulic network, virtually all of which is contained with a partition 71 separating the pockets 52 and 53, includes a relatively short vertical bore 72. At the upper end of the bore 72 is an annular valve seat 73 for accommodation of a ball check valve element 74. For confining the valve element 74 within an appropriate valve pocket 75 there is provided a retaining ring 76. From the pump chamber 57 above the valve pocket 75, a horizontal bore 77 communicates with expansion of pressure chamber 50 through a valve pocket 78. In the valve pocket 78 is a ball check valve 79 which is held in position by a retaining ring 80.

Figure 6:
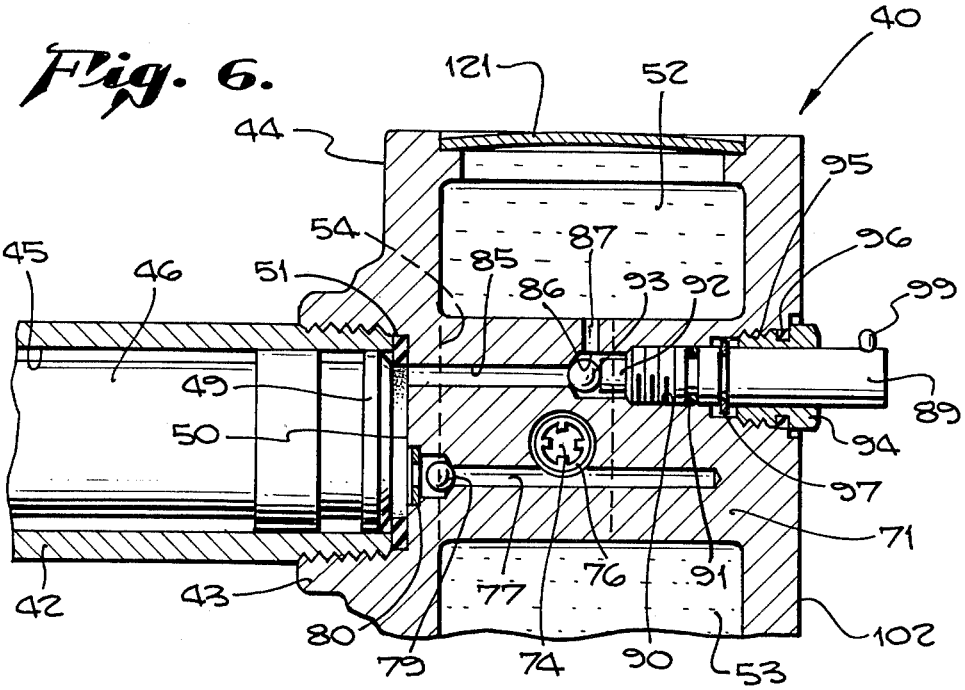
FIG. 6 is a fragmentary longitudinal sectional view on the line 6—6 of FIG. 4.
Figure 7:
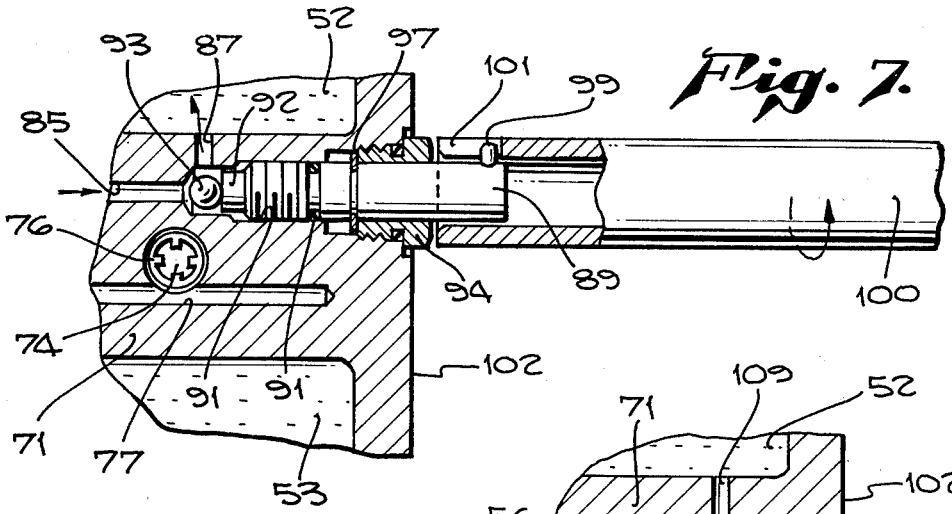
FIG. 7 is a fragmentary longitudinal sectional view of a portion of FIG. 6 showing the lift-lower valve in a different position of operation.
Figure 8:
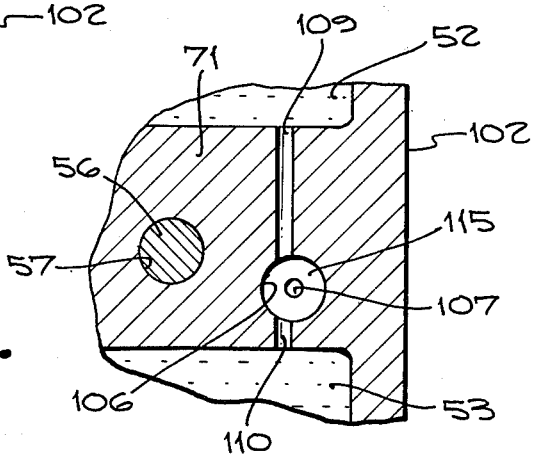
FIG. 8 is a fragmentary cross-sectional view on the line 8—8 of FIG. 5.

For effective discharge of hydraulic fluid from the expansion chamber 50, there is a horizontal bore 85, see FIG. 6, forming part of the hydraulic network within the partition 71. The bore 85 communicates with a pocket 86 and short horizontal bore 87 and thence with the pocket 52 of the hydraulic reservoir.

A valve, designated as a lift-lower valve 88, is manipulated to bleed off the expansion chamber 50 of the hydraulic chamber 45, thereby permitting the piston 46 to move in a direction from left to right allowing the elevating linkage to lower, primarily by gravity, assisted by the spring 30.

The lift-lower valve consists of the main of a plug 89 in threaded engagement with a recess 90 within the partition 71. There is an O ring 91 providing an inner seal against leakage of the hydraulic fluid when under pressure. A projection 92 of the plug 89 is adapted to engage a ball check valve element 93.

A packing gland 94 engages a threaded recess 95 in the partition 71 closing the threaded recess 95 with the aid of an O ring 96. A snap ring 97 may be fixed in the circumference of the plug 89 to limit axial movement of the plug 89.

The plug 89, provided as it is with a lateral projection 99, is adapted to receive a tubular handle 100 in which is provided an open end slot 101 by means of which the plug 89 can be engaged and rotated in one direction or another to apply pressure on, or release pressure from, the ball check valve 93. As clearly shown in FIGS. 4, 5 and 6, the lift-lower valve 88 is located within an outside wall 102 of the block 40, the lift-lower valve being almost in endwise alignment with the hydraulic cylinder 42. For further convenience, the pump assembly 55 is mounted on the upper wall 38 of the block 40, all mountings together with interconnecting passageways being virtually in the partition 71.

An overload release valve unit indicated generally by the reference character 105 is also located in the partition 71 as is a horizontal bore 106 and short vertical bore 107 which supplies it, see FIGS. 4, 5, 8 and 9. Another bore 109 is adapted to carry hydraulic fluid from the overload release valve 105 to the pocket 52 of the reservoir and a shorter bore 110 is adapted to carry hydraulic fluid to the pocket 53 of the reservoir. There is in the overload release valve unit 105 a pocket 111 in which is located a ball check valve element 112. A follower 113 is applied to the ball check valve element 112 by action of a spring 114. It is the spring 114 which determines the amount of pressure applied to the ball check valve element 112 in order to press it into engagement with its seat 115. A plug 116 is in threaded engagement with a threaded recess 117. The plug 116 has a wrench socket 118 in its open end, for purposes of adjusting tension on the spring 114, after which it is sealed by a mass of sealing material 119. A resilient ring 120 assists in manipulating the adjustment of tension in the spring 114, against which pressure is exerted by the threaded adjustment of the plug 116.

Not previously mentioned were the discs 121 and 122 which close outside ends of the respective pockets 52 and 53 comprising the reservoir. Fill plugs 123 provide access to the pockets 52 and 53 for filling the reservoir with hydraulic liquid. It is of consequence to note that all the bores making up the hydraulic network as well as the accompanying openings for accommodating such components as the pump piston 56, the lift-lower valve and its plug 89, and the overload release valve unit 105, all extend directly inwardly from outer surfaces of the block at the location of the partition 71. Where the bores intersect each other it is almost invariably in a right angular relationship, hence all openings can be drilled directly from the exterior and readily located within close tolerance allowances.

Figure 4:
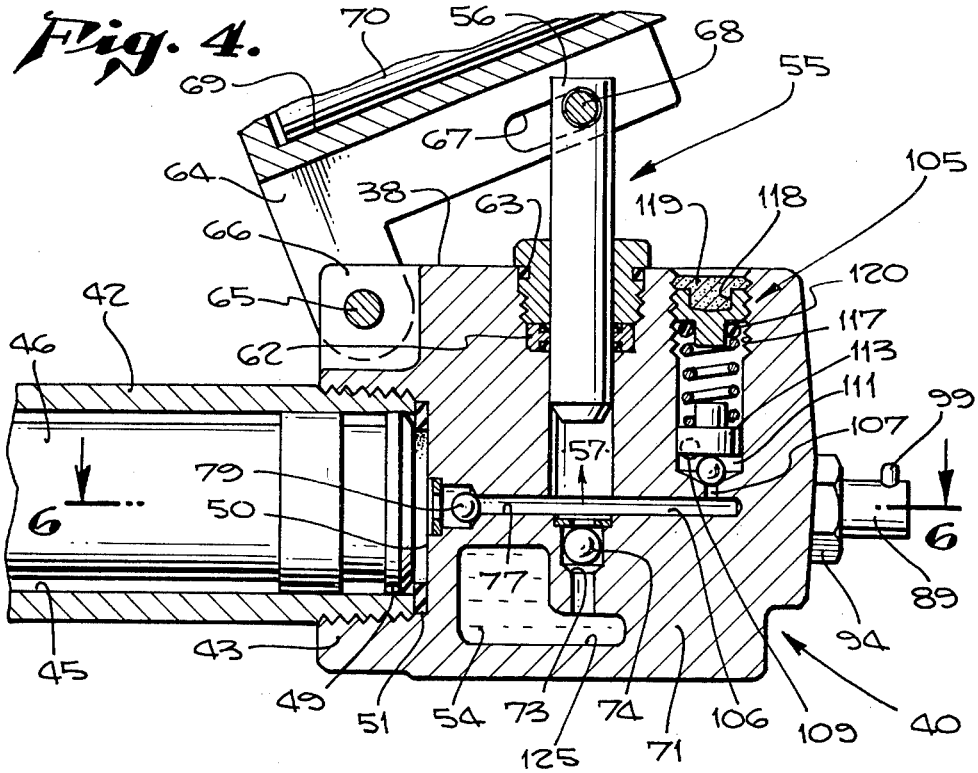
FIG. 4 is a fragmentary longitudinal sectional view on the line 4—4 of FIG. 2.
Figure 5:
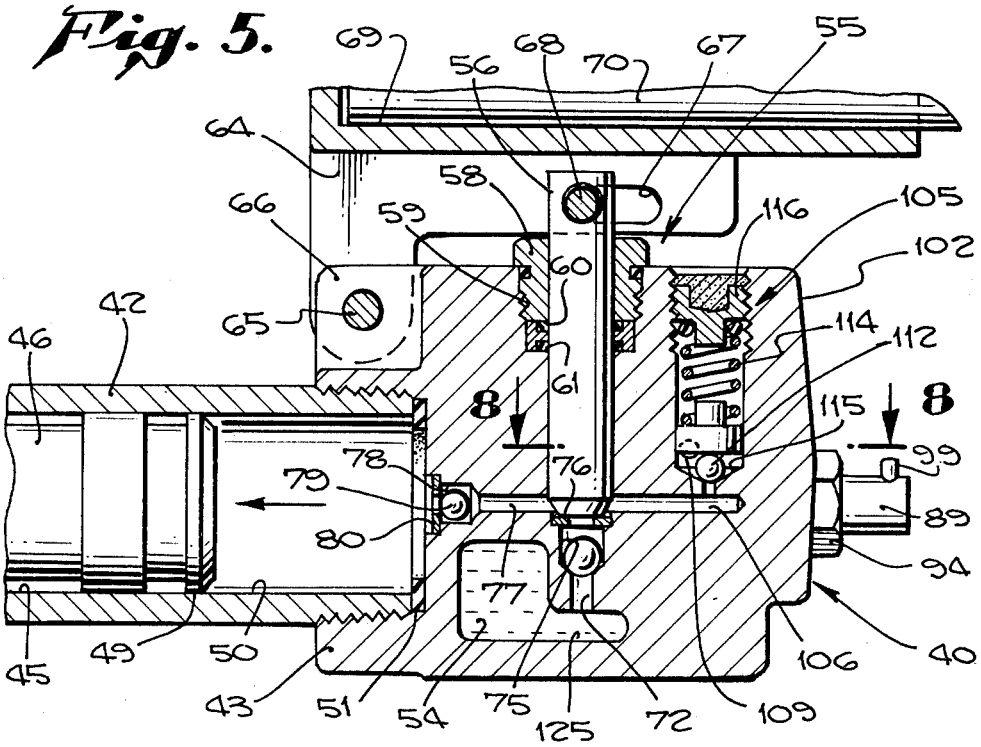
FIG. 5 is a fragmentary longitudinal view similar to FIG. 4 but showing the pump, piston and associated valving in a different position.

In operation let it be assumed that the elevating linkage is in its lowermost position. The lift-lower valve is then closed by rotating the plug 89 in the direction exerting pressure upon the ball check valve element 93 closing exit from the bore 85. This is accomplished by applying the tubular handle 100 to the plug and rotating it, after which the tubular handle may be removed. To raise the elevating linkage the handle 70 is inserted into an appropriate handle socket 69 of the yoke 64 and the yoke then reciprocated about the pivot pin 65. This causes the pump piston 56 to reciprocate in a vertical direction. On the upstroke, as illustrated in FIG. 4, hydraulic fluid is drawn from a relatively thin flat portion 125 of the passageway 54 into the bore 72 thence passed the ball check valve element 74 into the pump chamber 57. During this operation the ball check valve element 112 of the overload release valve unit 105 is forcibly seated upon its seat.

When the pump piston 56 is moved in a downward direction the ball check valve element 74 is then forced downwardly upon its seat 73 closing the bore 72. For normal pumping operation the ball check valve element 112 will remain seated upon its seat, closing the bore 107, by virtue of force present in the spring 114. Hydraulic fluid is then forced through the horizontal bore 77 past the ball check valve element 79 and thence into the expansion chamber 50 adjacent the piston head 49. As this action continues, hydraulic liquid continues to be pumped into the expansion chamber causing the piston 46 to move progressively from right to left. This causes the trunion 27 to shift from right to left pulling on the trunion arms 28 thus causing the elevating linkage to raise the lifting platform 24. The elevating linkage will remain locked in whatever elevating position remains because of seating of the ball check valve element 79 upon its seat, thereby to block any reverse flow from the expansion chamber 50.

When the elevating linkage is to be lowered, the tubular handle 100 is applied to the plug 89 and the plug rotated in a direction to relieve pressure upon the ball check valve element 93. The ball check valve element will permit hydraulic liquid to flow from the expansion chamber 50 through the horizontal bore 85, and thence through the bore 87 to the reservoir pocket 52 at a rate depending upon the distance the ball check valve element is permitted to shift away from its seat. The expansion chamber 50 accordingly, will progressively empty, the hydraulic liquid flowing back to the hydraulic reservoir in the block 40.

During the lifting operation, should pumping continue beyond the amount necessary to lift the elevating linkage to the full extent permitted by its construction when pressure will accordingly be built up by action of the pump piston 56 above the rated amount, continued pumping will then increase the pressure enough to unseat the ball check valve element 112 of the overload release valve unit 105, acting against tension built up in the spring 114. When this occurs, the surplus hydraulic liquid under excess pressure will pass through the bores 106 and 107 past the ball check valve element 112 and thence through the bores 109 and 110 back to the hydraulic pockets 52 and 53. Continued pumping will merely bypass more of the liquid and prevent overloading of the structure.

I claim:

1. A unitary multiple purpose oil block for mounting between a pair of side plates of a lifting jack frame and for support thereon of a hydraulic power cylinder for the lifting jack, said block comprising side faces, forward and aft end faces, a top face and a bottom face, means forming an oil reservoir in said block intermediate said side faces and a partition with a connecting passageway therethrough located intermediate said side faces dividing said reservoir into opposite chambers, a first hole in said forward end face for reception of said cylinder, a second hole located in a second of said faces and in alignment with said partition and having a reciprocating pump piston therein, a sealing bushing around the piston closing the outside end of said second hole, handle means, and a pivot connection between said handle means and said block in alignment with said partition pivotally mounting the handle means on the block in operating relationship with the piston, a third hole located in a third of said faces in alignment with said partition and having a rotatably adjustable lift-lower valve element therein, a sealing bushing around the lift-lower valve element, and a fourth hole located in the second of said faces in alignment with said partition and having an overload release valve member therein, an adjustable plug rotatably mounted in said fourth hole and hydraulic passageways in said partition extending inwardly from said respective holes, said passageways being adapted to interconnect the reservoir with said holes, said passageways being in mutual right angular relationship.

2. A unitary multiple purpose oil block as in claim 1 wherein said partition is substantially midway between opposite side faces of the block and said holes and passageways are all located in said partition.

3. A unitary multiple purpose oil block as in claim 2 wherein all interconnections between said passageways are at right angles.

4. A unitary multiple purpose oil block as in claim 1 wherein there is a boss around said first hole, a flange on said forward face of the block extending upwardly from said bushing and in alignment with said partition and with the longitudinal center line of the cylinder, and a yoke in alignment with the longitudinal axis of said handle and pivotally mounted on said flange and in operating engagement with said pump piston for actuating said pump piston.

5. A unitary multiple purpose oil block as in claim 1 wherein there is a substantially tamper resistant cover means in said fourth hole between said plug and the exterior, said cover means comprising a fracturable mass of specially identifiable character.

6. A unitary multiple purpose oil block as in claim 4 wherein the longitudinal axes respectively of the handle and the lift-lower valve are in parallel adjacent planes and in substantially parallel relationship in one extreme operative position of said handle.

* * * * *